US006451251B1

(12) United States Patent
Kim et al.

(10) Patent No.: US 6,451,251 B1
(45) Date of Patent: Sep. 17, 2002

(54) METHOD FOR MANUFACTURING BILLET USING AQUEOUS SALT SOLUTIONS

(75) Inventors: Dong Yik Kim; Sung Kyun Kim, both of Junrapuk-do (KR)

(73) Assignee: Future Metal Co., Ltd., Seoul (KR)

( * ) Notice: Subject to any disclaimer, the term of this patent is extended or adjusted under 35 U.S.C. 154(b) by 0 days.

(21) Appl. No.: 09/878,306

(22) Filed: Jun. 12, 2001

(30) Foreign Application Priority Data

Jan. 20, 2001 (KR) ..... 2001-3473
Apr. 2, 2001 (KR) ..... 2001-17342

(51) Int. Cl.[7] ..... B22F 1/00; B22F 1/02; B22F 3/20

(52) U.S. Cl. ..... 419/62; 419/64; 419/67

(58) Field of Search ..... 419/27, 36, 64, 419/67, 62

(56) References Cited

U.S. PATENT DOCUMENTS 4,614,637 A * 9/1986 Boncoeur et al. ..... 419/2
4,707,184 A * 11/1987 Hashiguchi et al. ..... 75/228
4,777,014 A * 10/1988 Newkirk et al. ..... 419/12

* cited by examiner

*Primary Examiner*—Daniel J. Jenkins
(74) *Attorney, Agent, or Firm*—Rosenberg, Klein & Lee

(57) ABSTRACT

Disclosed is a method for manufacturing a billet using aqueous salt solutions. The method for manufacturing a billet using aqueous salt solutions, comprising the following steps of: infiltrating aqueous salt solutions into metal powders or cut metal wires by adding the solutions to metal powders or cut metal wires filled in a cylindrical container, to obtain a mixture of aqueous salt solutions infiltrated into the metal powders or metal wires; evaporating water in aqueous salt solutions by heating said container containing the mixture, to obtain a dried mixture; and separating said dried mixture of metal powders or metal wires and salts from the container, to obtain a billet.

10 Claims, No Drawings

METHOD FOR MANUFACTURING BILLET USING AQUEOUS SALT SOLUTIONS

BACKGROUND OF THE INVENTION

1. Field of the Invention

The present invention relates to a method for manufacturing a billet using aqueous salt solutions, in particular, a method for manufacturing a billet, in which metal powders are mechanically deformed through an extruding or a rolling process, thereby preparing metal fillers which confer conductivity to paints, pastes, and plastics, and metal catalyst or electrode materials, sound absorption plate, and filter, which require large contacting area.

2. Description of the Prior Art

Conventionally, conductive paints and plastics used for screening electromagnetic waves have been prepared by mixing paints or resin with conductive fillers, in which the fillers have used metal powders, metal flakes, metal fibers, and metal-coated glass fibers. However, conductivity depends on the degree of contact between fillers so that fillers in the form of fibers having most excellent inter-fiber contact have been widely used. Meanwhile, metals used as catalysts and electrodes are required to have larger specific surface area for increasing reaction rates. As such, the specific surface area is maximized by using catalysts of the fiber form.

In addition, the filters employed in special circumstances, such as high temperature, are prepared by use of metal fibers, instead of synthetic fibers or natural pulps. Accordingly, various processes have been developed, for preparing metals in the form of thin fiber.

The metal fibers should have a diameter as small as possible, that is, 50 $\mu$m or less, so that they can be used as conductive fillers. The smaller the diameter, the lower the amount of filler needed to be mixed with resin or paints. Hence, general wire-processing methods, such as a drawing method, cannot prepare such metal fibers. So, specific methods as follows have been employed.

Methods of preparing metal fibers for conductive fillers are classified into a bundle drawing, a vibration cutting, a melt spinning in-rotating water and so on.

A bundle drawing has advantages that fibers can be prepared to a diameter of 10 $\mu$m or less, and length of fibers can be freely adjusted through the subsequent cutting procedure, but it suffers from the disadvantage of high cost in the procedures, such as a bundling of wires, repeated drawing, and a separating of wires after final drawing.

Additionally, a vibration cutting is advantageous in terms of simple processes, and applicability to all materials. However, vibration cutting has disadvantage that metal fibers with a diameter of 50 $\mu$m or less are difficult to prepare. For instance, in order to obtain sufficient conductivity, fibers with a diameter of 10 $\mu$m, prepared by a bundle drawing, are added in the amount of only 5 wt % to plastics, while fibers prepared by a vibration cutting are added in the amount of 35 wt % or more.

Though a melt spinning in-rotating water is more economical than said two prior processes, its products are limited to a diameter of 30 $\mu$m or more, attributable to surface tension of the ejecting melt stream. Therefore, conventional metal fiber-preparing methods have drawbacks of limited diameter of fibers or high preparation cost.

Optimal conductive fillers for conductive plastics, catalyst and electrodes are used in lengths of 1000–20,000 $\mu$m and a diameter of about 10–20 $\mu$m; and for conductive paints in 10–20 $\mu$m lengths of about 5 $\mu$m in diameter.

Korean Pat. No. 092100, by the present inventors, refers to a method for manufacturing metal fibers, in which metal powders and salt powders in predetermined sizes are kneaded, filled in a mold, compression-molded, and processed into a billet, which is then extruded, and salts present in extruded materials are dissolved in water and thus removed. Thereby, metal fibers with a diameter of 20 $\mu$m or less can be more easily prepared, compared with other methods, such as a bundle drawing.

In a method of said patent, metal powders are kneaded with salt powders, filled in a mold of suitable size, and compression-molded to obtain an extruding billet. The reason that metal powders are kneaded with salt powders is that metal powders are prevented from self-aggregating by salt powders. However, parts of metal powders tend to agglomerate, even though kneading is performed well. Such phenomenon have a negative influence on uniform control of diameter of metal fibers to be manufactured, thus a difficulty of quality control arises.

SUMMARY OF THE INVENTION

Accordingly, an object of the present invention for alleviating the problems as described above is to provide a method for manufacturing a powder-extruding billet in which most of metal powders are not agglomerated by salts, whereby the diameter of fibers prepared through the succeeding mechanical deformation processes, such as extruding or rolling, can be easily controlled.

Another object of the present invention is to provide a method for manufacturing a billet using aqueous salt solutions, in which, because of using aqueous salt solution, cut metal wires and mesh made from the wires, which are difficult to knead with salt powders, can be used as raw materials of metal fibers, whereby a selection range of raw materials can be broadened.

DETAILED DESCRIPTION OF THE INVENTION

According to the present invention, there is provided a method for manufacturing a billet using aqueous salt solutions, comprising infiltrating aqueous salt solutions into metal powders or cut metal wires by adding the solutions to metal powders or cut metal wires filled in a cylindrical airtight container of desired diameter and height; evaporating water in aqueous salt solutions by heating said container containing a mixture of aqueous salt solutions infiltrated into the metal powders or metal wires; and separating dehydrated mixture of metal powders or metal wires and salts from the container, to obtain a billet.

In addition, there is provided a method for manufacturing a billet using aqueous salt solutions, comprising coating aqueous salt solutions to surfaces of metal wires or mesh made from the wires by settling metal wires or mesh into aqueous salt solutions; removing water in aqueous salt solutions by drying aqueous salt solutions-coated metal wires or mesh; and compression-molding said wires or mesh rolled into a cylindrical form of a suitable size, in a mold, to obtain a billet.

Metal fibers prepared according to the present invention are not limited in their kinds. In this regard, materials of metal powders, metal wires or mesh made from the wires are exemplified by metal composite obtained by plating Ni, Ag, Cu, Au or Pt, onto Pt, Pd, Al and Al alloy, Ag and Ag alloy, Ni and Ni alloy, Cu and Cu alloy, Ti and Ti alloy, Co and Co alloy, Fe and Fe alloy, and powders or wires thereof; and stainless steel.

Said salts can be selected from the group consisting of chloride salts, including sodium chloride, barium chloride, and potassium chloride; sulfates, including potassium sulfate, sodium sulfate, magnesium sulfate, and lithium sulfate; carbonates, such as potassium carbonate; phosphates, such as potassium phosphate; and fluoride salts, such as sodium fluoride.

Preferably, the aqueous salt solutions are saturated.

During manufacturing of said billet, before the mixture is separated from the container following the removal of water, the procedure in which aqueous salt solutions are again introduced and then evaporated is repeated several times. Thereby, a mixture ratio of metal and salts can be controlled. As necessary, when said materials are filled and evaporated, the mixture may be subjected to pressing under a proper pressure or vacuum. Also, it is favorable that said container is airtight.

The metal powders mentioned in the present invention, are referred to ones containing single metal or alloy powder thereof. In addition, the method for manufacturing the powders has no limitation.

The aqueous salt solutions means that water-soluble salts, such as sodium chloride, potassium sulfate, sodium sulfate, magnesium sulfate, potassium carbonate, potassium phosphate, and lithium sulfate, are dissolved to saturation in water in a temperature range of from room temperature to suitably high temperatures, determined by kinds of salts.

As a drawing process, an extrusion is used in the present invention, but a rolling may be used.

A better understanding of the present invention may be obtained in light of the following examples which are set forth to illustrate, but are not to be construed to limit the present invention.

EXAMPLE 1

Aluminum powders with a particle size of 75–150 $\mu$m were charged into a container having an inner diameter of 50 mm and a height of 10 cm. 50 g of sodium chloride was dissolved in 100 cc of water at 70° C. (parts of solute were not dissolved and present as a crystal state), to prepare aqueous sodium chloride solution. Said aqueous solution was introduced into said container. At that time, salt solution was infiltrated into the aluminum powders. The container in which a mixture comprising salt solution infiltrated into metal powders was contained was charged to a furnace preheated at 150° C., thereby evaporating water. After all water was evaporated, said aqueous sodium chloride solution was added to water-removed remainder and then again evaporated. Such procedure was repeated 3 times. As water from aqueous sodium chloride solution infiltrated into the metal powders was evaporated, solid sodium chloride remained. The mixture of metal powders and salts was removed from the container, to obtain an extruding billet for manufacturing aluminum fiber with a diameter of 50 mm and a length of 10 cm.

EXAMPLE 2

Aluminum wires with a diameter of 200 $\mu$m were cut into 5–20 mm lengths and then charged to a container having an inner diameter of 50 mm and a height of 10 cm under suitable pressure. 50 g of sodium chloride was dissolved in 100 cc of water at 70° C. (parts of solute were not dissolved and present as a crystal state), to prepare aqueous sodium chloride solution. Said salt solution was introduced into said container. At that time, salt solution was infiltrated into the cut aluminum wires. The container in which a mixture comprising salt solution infiltrated into the cut aluminum wires was contained was charged to a furnace preheated to 150° C., thereby evaporating water. After all water was evaporated, said aqueous sodium chloride solution was added to water-removed remainder and then again evaporated. Such procedure was repeated 3 times. As water from aqueous sodium chloride solution infiltrated into the cut aluminum wires was evaporated, solid sodium chloride remained. The mixture of metal wires and salts was removed from the container, to obtain an extruding billet for manufacturing aluminum fiber with a diameter of 50 mm and a length of 10 cm.

EXAMPLE 3

Aluminum wires with a diameter of 150 $\mu$m was passed through aqueous sodium chloride solution prepared by dissolving 50 g of sodium chloride in 100 cc of water at 70° C. (parts of solute were not dissolved and present as a crystal state). Thereafter, the aluminum wires were charged to a furnace maintained at 80° C. and thus dried. The aluminum wires were rolled into a bundle form with an outer diameter of 50 mm, and then charged to a mold having an inner diameter of 50 mm and a height of 10 cm. The mold was compression-molded under a load of 50 tons. An extruding billet composed essentially of aluminum wires and salts for manufacturing aluminum fibers was obtained in a diameter of 50 mm and a length of 10 cm by separating it from the mold.

EXAMPLE 4

A mesh prepared from aluminum wires with a diameter of 150 $\mu$m was cut into 10 cm widths and then passed through aqueous sodium chloride solution obtained by dissolving 50 g of sodium chloride in 100 cc of water at 70° C. (parts of solute were not dissolved and present as a crystal state). Thereafter, the aluminum mesh was charged to a furnace maintained at 80° C. and thus dried. The aluminum mesh was rolled into a bundle form with an outer diameter of 50 mm, and then charged to a mold having an inner diameter of 50 mm and a height of 10 cm. The mold was compression-molded under a load of 50 tons. An extruding billet composed of aluminum mesh and salts, with a diameter of 50 mm and a length of 10 cm, was obtained by separating it from the mold, and used to manufacture aluminum fibers.

As described above, by manufacturing a billet comprising a mixture of metal with salts through the method of the present invention, each metal powder or cut metal wire is not agglomerated by salt so that, when metal fibers are prepared through the following processes, such as extruding, a diameter of the fibers can be exactly controlled.

In addition, the use of aqueous salt solutions has the advantage of making it possible to use the cut metal wires and mesh made from the wires, which are difficult to use with salt powders, as raw materials of metal fibers, thereby manufacturing metal fibers with uniform diameter.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method for manufacturing a billet using aqueous salt solutions, comprising the following steps of:

mixing metal powders or cut metal wires with aqueous salt solutions to obtain a mixture;

heating said mixture at a temperature, capable of evaporating water, to obtain a dried mixture; and compression-molding said dried mixture, to yield a billet.

2. A method for manufacturing a billet using aqueous salt solutions, comprising the following steps of:

infiltrating aqueous salt solutions into metal powders or cut metal wires by adding the solutions to metal powders or cut metal wires filled in a cylindrical container, to obtain a mixture of aqueous salt solutions infiltrated into the metal powders or metal wires;

evaporating water in aqueous salt solutions by heating said container containing the mixture, to obtain a dried mixture; and separating said dried mixture of metal powders or metal wires and salts from the container, to obtain a billet.

3. A method for manufacturing a billet using aqueous salt solutions, comprising the following steps of:

coating aqueous salt solutions to surfaces of metal wires or mesh made from the wires by settling metal wires or mesh into the aqueous salt solutions;

evaporating water in aqueous salt solutions by heating aqueous salt solutions-coated metal wires or mesh; and compression-molding said salt-coated metal wires or mesh rolled into a cylindrical form, in a mold, to obtain a billet.

4. The method as set forth in claim 2, wherein said metal powders or metal wires are at least one selected from the group consisting of Pt, Pd, Al and Al alloy, Ag and Ag alloy, Ni and Ni alloy, Cu and Cu alloy, Ti and Ti alloy, Co and Co alloy, Fe and Fe alloy.

5. The method as set forth in claim 2, wherein said metal powders or metal wires are at least one metal composite being obtained by plating Ni, Ag, Cu, Au or Pt, onto one metal powders or metal wires selected from the group consisting of Pt, Pd, Al and Al alloy, Ag and Ag alloy, Ni and Ni alloy, Cu and Cu alloy, Ti and Ti alloy, Co and Co alloy, Fe and Fe alloy.

6. The method as set forth in claim 2, wherein said metal powders or metal wires are stainless steel.

7. The method as set forth in claim 2, wherein said salts are selected from the group consisting of chloride salts, including sodium chloride, barium chloride, and potassium chloride; sulfates, including potassium sulfate, sodium sulfate, magnesium sulfate, and lithium sulfate; carbonates, such as potassium carbonate; phosphates, such as potassium phosphate; and fluoride salts, such as sodium fluoride.

8. The method as set forth in claim 2, wherein, before the mixture is separated from the container following the removal of water, the procedure in which aqueous salt solutions are again introduced and then evaporated is repeated 2 times or more.

9. The method as set forth in claim 2, wherein said container is airtight.

10. The method as set forth in claim 2, wherein addition of aqueous salt solutions to a container containing said metal powders or metal wires is conducted under pressurized state or vacuum state.

* * * * *